US007422437B1

(12) United States Patent
Lin et al.

(10) Patent No.: US 7,422,437 B1
(45) Date of Patent: Sep. 9, 2008

(54) PORTABLE ADAPTER

(75) Inventors: Yi-Ching Lin, Taipei Hsien (TW); Ming-Chou Kuo, Taipei Hsien (TW); Jung-Hui Hsu, Taipei Hsien (TW)

(73) Assignee: Powertech Industrial Co., Ltd., Taipei Hsien (TW)

( * ) Notice: Subject to any disclaimer, the term of this patent is extended or adjusted under 35 U.S.C. 154(b) by 0 days.

(21) Appl. No.: 11/829,480

(22) Filed: Jul. 27, 2007

(30) Foreign Application Priority Data

Mar. 15, 2007 (TW) ..... 96108899 A

(51) Int. Cl.
*H01R 39/00* (2006.01)

(52) U.S. Cl. ..... 439/11; 439/640

(58) Field of Classification Search ..... 439/11, 439/640, 638

See application file for complete search history.

(56) References Cited

U.S. PATENT DOCUMENTS 6,551,142 B2 * 4/2003 Eisenbraun ..... 439/668
6,786,734 B2 * 9/2004 Yu ..... 439/11
6,971,920 B2 * 12/2005 Crupi ..... 439/654
7,306,471 B2 * 12/2007 Shau-din ..... 439/171
2004/0048494 A1 * 3/2004 Yu ..... 439/11
2004/0229478 A1 * 11/2004 Chen ..... 439/11
2006/0246742 A1 * 11/2006 Sun ..... 439/11

* cited by examiner

*Primary Examiner*—Gary F. Paumen
(74) *Attorney, Agent, or Firm*—Rosenberg, Klein & Lee

(57) ABSTRACT

A portable adapter includes a first body; a second body; a pivoting unit, mounted between the first body and the second body; a power input, mounted on the first body; a power output, mounted on the first body near to the pivoting unit; and at least one connector, mounted on the second body. The pivoting unit unfolds the first body and the second body in a manner such that the power output is partially hidden between the first body and the second body. The foldable structure of the portable adapter has a reduced volume and the power output is partially hidden during travel. When in use with a laptop, the first body and the second body unfold to an angle of 90 degrees relative to each other by means of the pivoting unit, so that the connector can be plugged with an electronic device.

8 Claims, 3 Drawing Sheets

PORTABLE ADAPTER

BACKGROUND OF THE PRESENT INVENTION

1. Field of the Present Invention

The present invention generally relates to a portable adapter, and more particularly to a portable adapter which can be used as a relay to provide a connection between an electrical power socket and communication wires.

2. Description of the Related Art

A conventional converter for a laptop used for travel can be connected to a portable adapter. The portable adapter is located between a portable adapter and a power line and can thus be used as a relay, thereby forming a connection between the portable adapter and the communication lines.

TW Patent No. 470270, published on Dec. 21, 2001, discloses a relay for communication devices. The above portable adapter (relay) has a power input and a power output. The power output is exposed through a main body of the portable adapter, and tends to be damaged due to deformation or distortion caused by impacts. Furthermore, the main body of the above portable adapter has an unchangeable size which occupies a certain space and is thus inconvenient for traveling with. Combining the portable adapter and the laptop cannot reduce the volume.

Therefore, there is a need for an improved portable adapter used for travel, which overcomes the shortcomings of the prior art.

SUMMARY OF THE PRESENT INVENTION

It is an object of the present invention to provide a portable adapter used for travel, which reduces the space the portable adapter occupies while the power output is hidden and thus protected from being deformed. When the portable adapter is used in combination with a laptop, the portable adapter can be unfolded to have its first body and second body located at an angle of 180 degree relative to each other, so that the portable adapter is more convenient for plugging with an external device. In addition, the portable adapter can be folded when not in use.

In order to achieve the above and other objects, the portable adapter according to the invention includes a first body; a second body; a pivoting unit, mounted between the first body and the second body; a power input, mounted on the first body; a power output, mounted on the first body near to the pivoting unit; and at least one connector, mounted on the second body. The pivoting unit unfolds into the first body and the second body so that the power output is at least partially hidden between the first body and the second body.

The portable adapter according to the invention is foldable. During travel or when being transported, the portable adapter can be unfolded so that its first part and second part are positioned at 180 degree relative to each other, reducing the space occupied by the portable adapter and protecting the power output from being damaged. When in use with the laptop, the first body and the second body unfold to an angle of 90 degrees relative to each other by means of the pivoting unit, for the connector to plug with another device.

To provide a further understanding of the present invention, the following detailed description illustrates embodiments and examples of the present invention, this detailed description being provided only for illustration of the present invention.

DETAILED DESCRIPTION OF THE EMBODIMENTS

Figure 1:
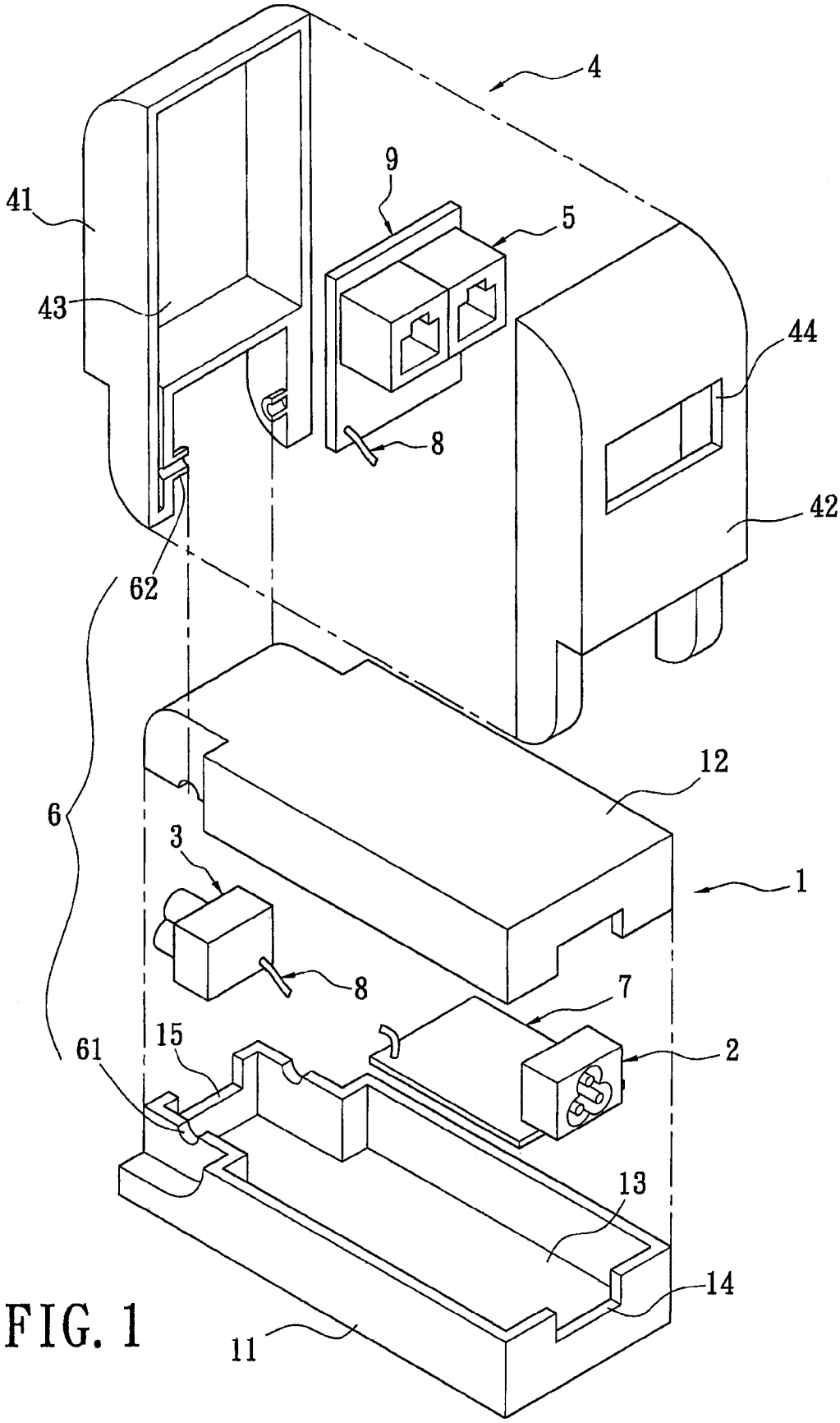
FIG. 1 is an exploded view of a portable adapter used for travel according to a first embodiment of the invention.

Wherever possible in the following description, like reference numerals will refer to like elements and parts unless otherwise illustrated.

Figure 2:
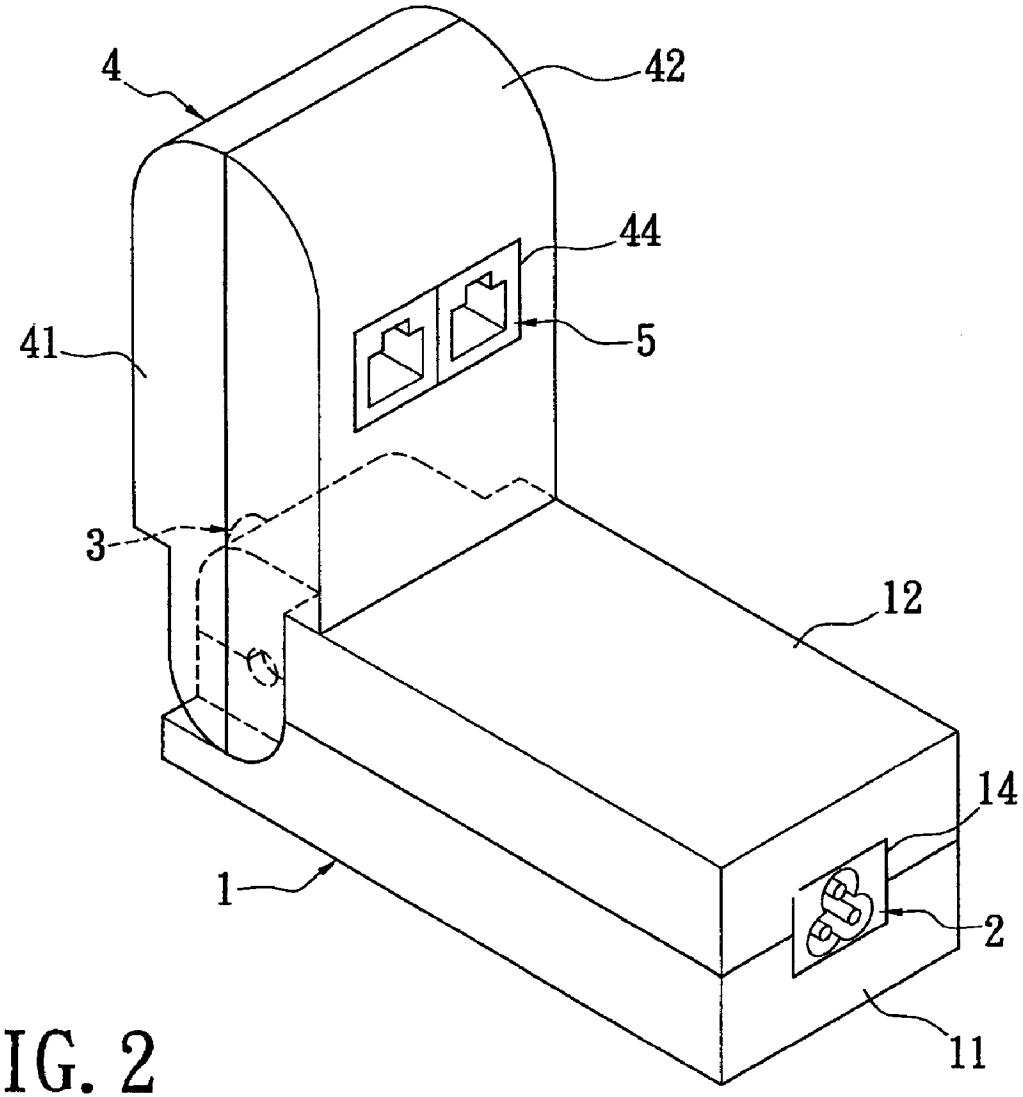
FIG. 2 is a perspective view of a portable adapter used for travel according to a first embodiment of the invention.

Referring to FIG. 1 and FIG. 2, a portable adapter used for travel according to a first embodiment of the invention includes a first body 1, a power input 2, a power output 3, a second body 4, two connectors 5 and a pivoting unit 6. The first body 1 includes a first half part 11 and a second half part 12, which can be assembled together by engaging, screwing or ultrasonically welding. The first body 1 further has a first accommodating space 13 inside.

The first body 1 has a first opening 14 and a second opening 15 formed at opposite sides thereof. The power input 2 is received in the first opening 14 of the first body 1 in a manner which partially exposes the power input 2 through one side of the first body 1. The power input 2 is further fixed onto a first circuit board 7. The power input 2 can be a connector of any known format. In this embodiment, the power input 2 is a European standard male connector. The circuit board 7 is received in the first accommodating space 13 to electrically connect to the power input 2. The first circuit board 7 further has a protruding wave protection circuit (not shown) which provides a protecting function to prevent any sudden protruding waves from being generated.

The power output 3 is received in the second opening 15 of the first body 1 at the position next to the pivoting unit 6, in a manner which partially exposes the power output 3 through another side of the first body 1. The power output 3 can be a connector of any known format. In this embodiment, the power output 3 is a European standard female connector. The power output 3 is electrically connected to the first circuit board 7 via conductive wires 8. The power input 2 is connected to an external power line to input required power. The power output 3 is connected to a converter for external devices such as laptops so that power can be transmitted to the external devices.

The second body 4 includes a first half part 41 and a second half part 42, which can be assembled together by engaging, screwing or ultrasonically welding. The second body 4 further has a second accommodating space 43 inside for receiving a second circuit board 9.

The second body 4 has a third opening 44 for receiving the two connectors 5. The two connectors 5 are partially exposed through one side of the second body 4, and are further fixed onto and electrically connected to the second circuit board 9. The two connectors 5 can be connectors for telephone lines or internet cables. In this embodiment, the two connectors 5 are used to respectively input and output signals. The second circuit board 9 further has a protruding wave protection circuit (not shown) which provides a protecting function to prevent any sudden protruding waves from being generated. The second circuit board 9 can be further electrically connected to the first circuit board 7 via the conductive wires 8.

The pivoting unit 6 is mounted between the first body 1 and the second body 4. The configuration of the pivoting unit 6 is not particularly limited as long as the first body 1 and the second body 4 can be pivotally connected to each other. In this embodiment, the pivoting unit 6 includes two axial holes 61 and two rotating axils 62. The axial holes 61 are formed through the first body 1 near to the second opening 15. The two rotating axils 62 are placed through opposite sides of the second body 4, corresponding to the axial holes 61 so that the first body 1 and the second body 4 can be pivotally connected to each other by the pivoting unit 6. Thereby, the portable adapter used for travel according to the invention is achieved.

In addition to the protruding wave protection, the portable adapter used for travel according to the invention also provides surge protection for the telephone line or internet cable connections, granting the user more convenience and safety when using their electronic devices.

Figure 3:
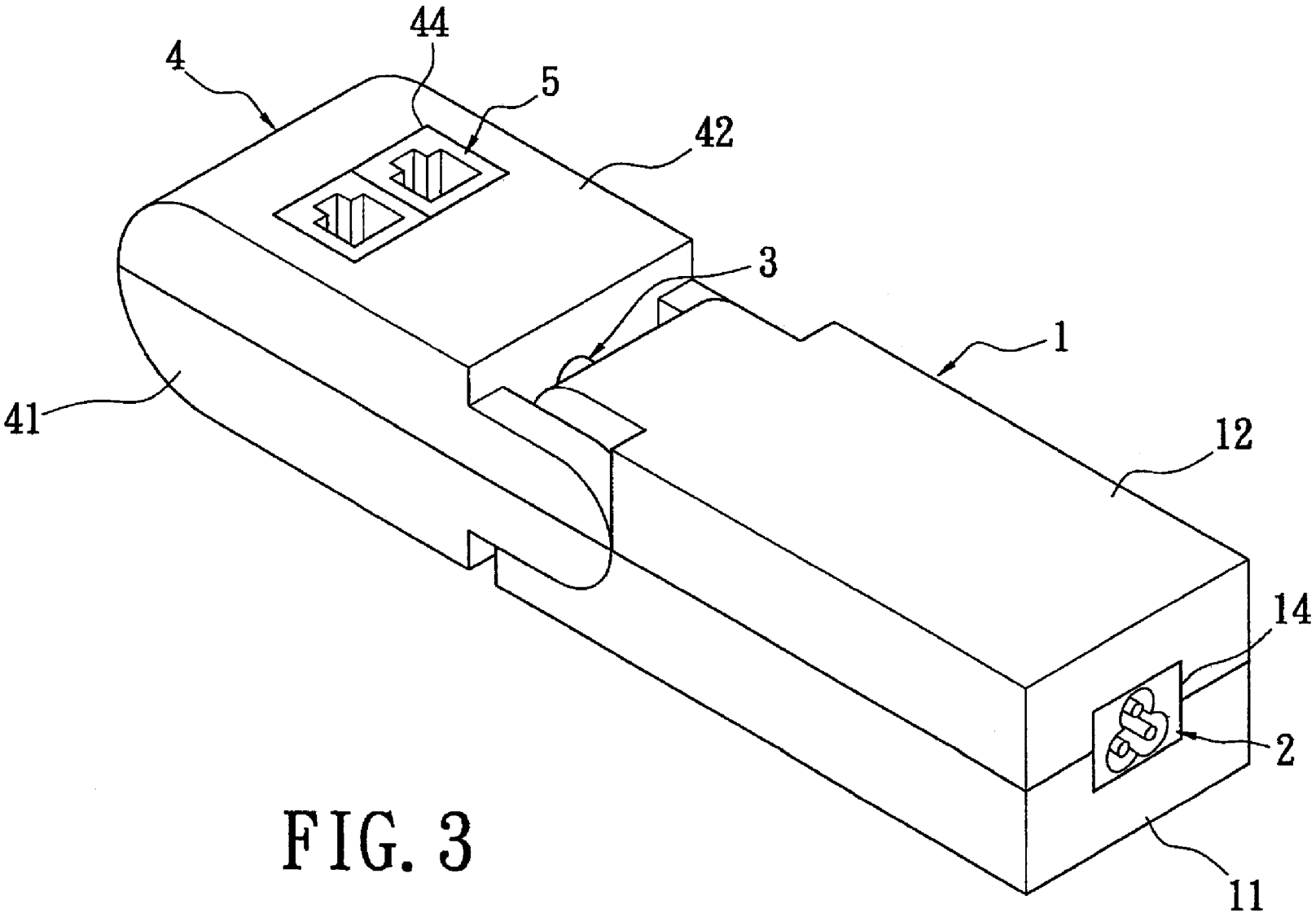
FIG. 3 is a perspective view of a portable adapter used for travel according to another embodiment of the invention.

Furthermore, the portable adapter used for travel according to the invention is foldable. Therefore, the pivoting unit 6 unfolds the first body 1 and the second body 4 at an angle of 180 degrees relative to each other, as shown in FIG. 3 to reduce the volume of the portable adapter when the portable adapter is packed for traveling or transportation. When the portable adapter according to the inventing is used in combination with a converter for a laptop, the pivoting unit 6 allows the first body 1 and the second body 4 to unfold to an angle of 90 degrees relative to each other, as shown in FIG. 2, for the connectors 5 for a telephone line or an Internet cable to plug in or out from the laptop.

Unfolding the first body 1 and the second body 4 at the angle of 180 degrees allows the power output 3 to be completely hidden inside a space formed between the first body 1 and the second body 4, so that the power output 3 can be protected from being deformed by impacts. When used in combination with the laptop, the connectors 5 can be exposed only by unfolding the first body 1 and the second body 4 to the angle of 90 degrees whereas the portable adapter 3 is partially hidden between the first body 1 and the second body 4, which requires less space for holding this portable adapter.

It should be apparent to those skilled in the art that the above description is only illustrative of specific embodiments and examples of the present invention. The present invention should therefore cover various modifications and variations made to the herein-described structure and operations of the present invention, provided they fall within the scope of the present invention as defined in the following appended claims.

What is claimed is:

1. A portable adapter used for travel, comprising:

a first body;

a second body;

a pivoting unit, mounted between the first body and the second body;

a power input, mounted on the first body;

a power output, mounted on the first body near to the pivoting unit; and at least one connector, mounted on the second body, wherein the pivoting unit unfolds the first body and the second body in a manner such that the power output is at least partially hidden between the first body and the second body.

2. The portable adapter of claim 1, wherein the first body comprises a first half part and a second half part, the first half part and the second half part being assembled together, the first body further having a first accommodating space inside thereof for receiving a first circuit board, the portable adapter being electrically connected to the first circuit board which has a protruding wave protection circuit.

3. The portable adapter of claim 1, wherein the first body has a first opening and a second opening formed at opposite sides thereof, the power input being received in the first opening, and the power output being received in the second opening.

4. The portable adapter of claim 1, wherein the second body comprises a first half part and a second half part, the first half part and the second half part of the second body being assembled together, the second body having a second accommodating space inside for receiving a second circuit board which is electrically connected to the connectors and has a protruding wave protection circuit.

5. The portable adapter of claim 1, wherein the second body further has a third opening for receiving the connectors.

6. The portable adapter of claim 1, wherein the pivoting unit includes two axial holes and two rotating axils, the axial holes being formed through the first body, the two rotating axils being placed through opposite sides of the second body to correspond to the axial holes, so that the first body and the second body are pivotally connected to each other by the pivoting unit.

7. The portable adapter of claim 1, wherein the number of the connectors is two.

8. The portable adapter of claim 1, wherein the connectors are connectors for telephone lines or internet cables.

* * * * *